United States Patent [19]

Jones

[11] 4,134,475

[45] Jan. 16, 1979

[54] ADJUSTABLE PAD HYDRAULIC LIFT

[75] Inventor: Raymond E. Jones, Lexington, Ky.

[73] Assignee: Dura Corporation, Southfield, Mich.

[21] Appl. No.: 808,116

[22] Filed: Jun. 20, 1977

[51] Int. Cl.[2] ..... B66F 7/16

[52] U.S. Cl. ..... 187/8.75

[58] Field of Search ..... 187/8.75, 8.74, 8.67, 187/8.45, 8.41; 248/298

[56] References Cited

U.S. PATENT DOCUMENTS

| | | | |
|---|---|---|---|
| 2,592,845 | 4/1952 | Aron | 187/8.75 |
| 2,777,538 | 1/1957 | Cochin | 187/8.75 |
| 2,899,020 | 8/1959 | Halstead | 187/8.75 |
| 3,318,417 | 5/1967 | Royce | 187/8.41 |
| 3,331,470 | 7/1967 | Hott | 187/8.75 |
| 3,709,330 | 1/1973 | Wells et al. | 187/8.75 |

*Primary Examiner*—Robert B. Reeves

*Assistant Examiner*—Jeffrey V. Nase

*Attorney, Agent, or Firm*—Hill, Gross, Simpson, Van Santen, Steadman, Chiara & Simpson

[57] ABSTRACT

An adjustable pad hydraulic lift structure has a vehicle engaging and supporting pad vertically movable by a hydraulic piston, the pad being mounted on a bolster and having load transfer blocks facing downwardly for engagement with the bolster to transfer vehicle load from the pad to the bolster. Supporting and guide rods on the bolster and bearings on the pad cooperate to support the unloaded pad for adjustment into selected position over the bolster, and while supporting the unloaded pad maintaining the pad at an elevation wherein the load transfer blocks are supported free of the bolster to permit free adjustments of the pad. The supporting and guide rods are yieldable when the pad is under vehicle load to permit the load transfer blocks to engage the bolster for load transfer from the pad to the bolster.

16 Claims, 6 Drawing Figures

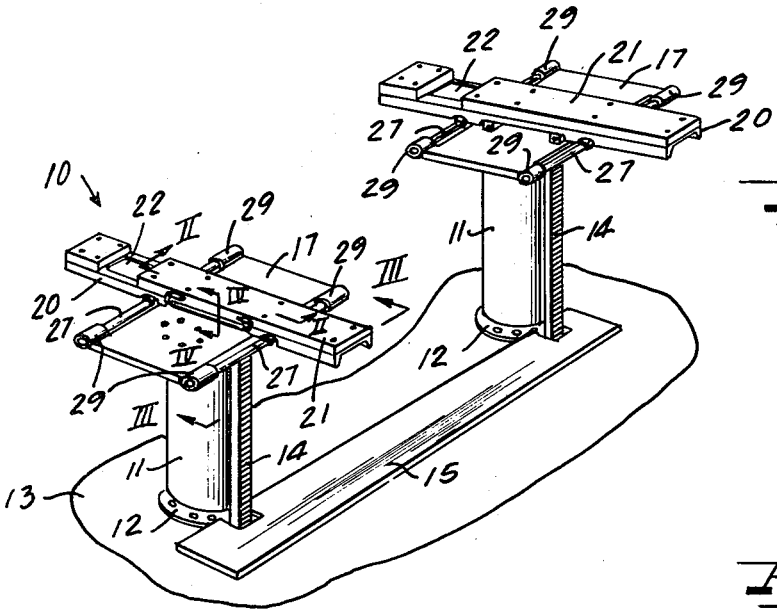
Fig. 1
Fig. 2
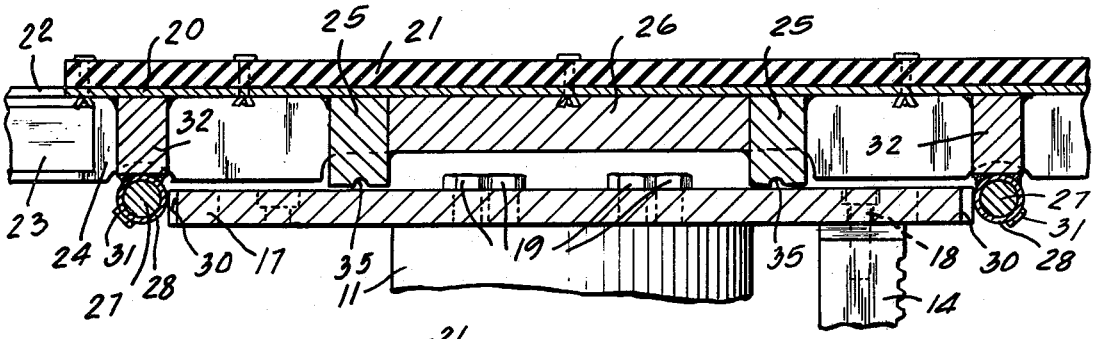
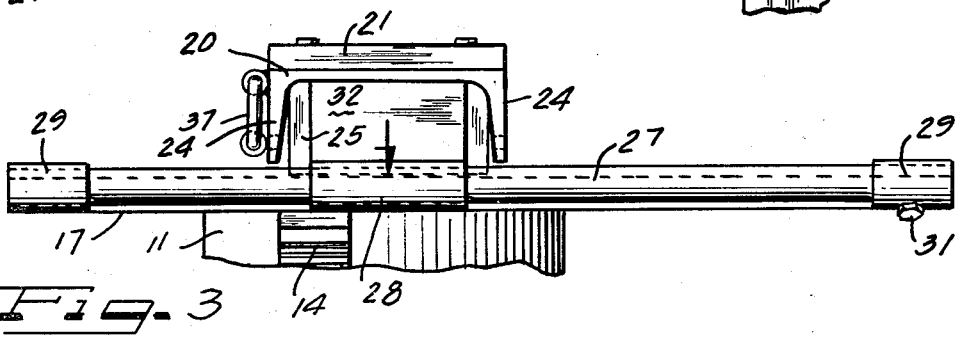
Fig. 3
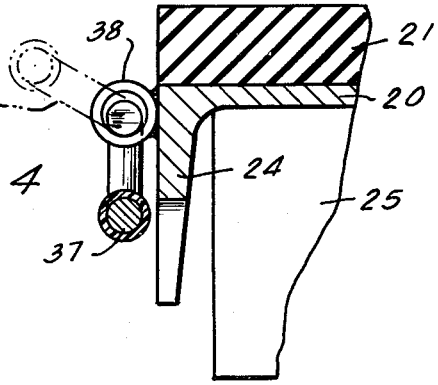
Fig. 4

ADJUSTABLE PAD HYDRAULIC LIFT

This invention relates to an adjustable pad hydraulic lift structure wherein a vehicle supporting pad is vertically movable by means of a hydraulic piston to engage under an automotive vehicle undercarriage for lifting the vehicle, and is more particularly concerned with new and improved means to facilitate adjusting the pad.

Numerous and varied devices have been proposed for the chassis or undercarriage or frame engagement of automotive vehicles for lifting the vehicles on one or more hydraulically actuated pistons to gain access to the undersides of the vehicles for any of a number of well known purposes. In general, the hydraulic vehicle lift structures are installed in automotive service centers and garages and the vehicle engaging structure is constructed and arranged to lie on or in the service area floor so that the vehicle to be serviced can be driven onto or over the structure which is then actuated to engage and lift the vehicle to the desired height. Various adjustment means have been proposed for accommodating the many different sizes and configurations of vehicle undercarriages to accommodate ever-changing models and styles.

Some vehicle lifts are especially designed to engage the vehicle axles. An example of such a lift is found in U.S. Pat. No. 2,592,845 which has a bolster frame on which transverse members adjustable on the frame are engageable with the vehicle axles.

In another example represented in U.S. Pat. No. 2,956,645, the vehicle lift comprises an H-shaped frame having rails to extend longitudinally under the vehicle and engage the vehicle chassis frame. One of the rails of the lift is transversely adjustable along the supporting cross member or bolster of the device. This arrangement is often preferred to the type of lift which engages the vehicle through its axles because by engaging the vehicle frame, the vehicle suspension can be worked on with substantial freedom.

Whereas in vehicle lifts as represented by the foregoing enumerated patents, adjustments for vehicle undercarriages of different sizes are adapted to be made, such adjustments are not as freely made as desirable due primarily to full bearing contact between the pad structure and the bolster or supporting frame. The bearing surfaces can for various reasons such as dirt, lack of greasing attention, corrosion, and the like hamper sliding adjustment to the extent of making adjustments quite difficult, especially after the apparatus has been in use for some time.

It is, accordingly, an important object of the present invention to provide a new and improved adjustable pad hydraulic lift structure in which improved adjustability is provided for in respect to the vehicle engaging and supporting pad means.

Another object of the invention is to provide new and improved supporting and guide means for the vehicle engaging and supporting pads of hydraulic lift structure wherein efficient positive load transfer from the vehicle engaging pad to the bolster of the lift is effected, but in the unloaded condition, the pad means can be easily adjusted without interference from the load supporting bearing surfaces.

According to features of the invention there is provided in an adjustable pad hydraulic lift structure wherein a vehicle engaging and supporting pad is vertically movable by means of a hydraulic piston to engage under an automotive vehicle undercarriage for lifting the vehicle, a bolster having means for securing the bolster on the upper end of the piston, said pad carried by the bolster, load transfer means facing downwardly on the pad for engagement with the bolster to transfer vehicle load from the pad to the bolster, and supporting and guide means on the bolster and on the pad cooperating to support the unloaded pad for adjustment into selected position over the bolster, and while supporting the unloaded pad maintaining the pad at an elevation wherein said load transfer means are supported free of the bolster to permit free adjustments of the pad, said supporting and guide means being yieldable when the pad is under vehicle load to permit said load transfer means to engage the bolster for load transfer from the pad to the bolster.

According to other features of the invention there is provided in an adjustable pad hydraulic lift structure wherein a vehicle supporting pad is vertically movable by means of a hydraulic piston to engage under an automotive vehicle undercarriage for lifting the vehicle, a bolster having means for securing the bolster to the top of the piston, load transfer means on said pad for engaging the bolster to transfer a vehicle load from the pad to the bolster, guide rods carried in parallel coextensively extending relation along opposite sides of the bolster, and bearing means on said pad in guiding engagement with said rods to facilitate adjusting the position of the pad on the bolster.

Other objects, features and advantages of the invention will be readily apparent from the following description of a certain representative embodiment thereof, taken in conjunction with the accompanying drawings although variations and modifications may be effected without departing from the spirit and scope of the novel concepts embodied in the disclosure and in which:

FIG. 1 is an isometric view of hydraulic lift structure embodying features of the invention.

FIG. 2 is an enlarged fragmentary vertical sectional detail view taken substantially along the line II—II in FIG. 1.

FIG. 3 is a vertical elevational view taken substantially in the plane of line III—III in FIG. 1.

FIG. 4 is a fragmentary vertical sectional elevational detail view taken substantially along the line IV—IV in FIG. 1.

Figure 5:
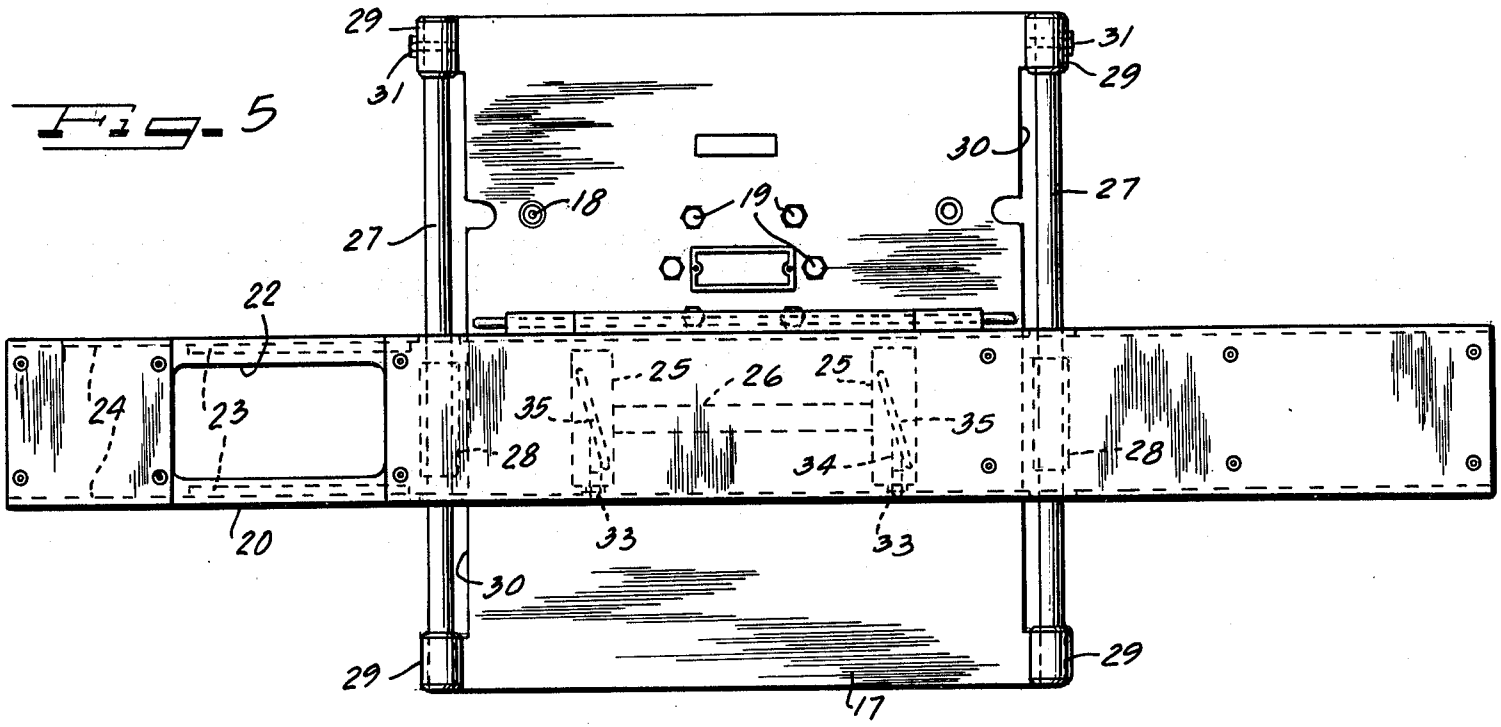
FIG. 5 is a top plan view of one of the bolster and pad assemblies.

On reference to the drawings, FIG. 1 depicts an adjustable pad hydraulic lift structure 10 of the dual piston type embodying features of the invention, although it will be apparent that a single piston lift structure may incorporate the invention. In the dual piston structure selected to exemplify the invention, a pair of hydraulic pistons 11 are vertically reciprocably movable in respective cylinders 12 sunk in suitable pits in a vehicle service area 13. Synchronized operation of the pistons 11 is assured by means of respective vertical racks 14 which are coupled by pinions on a common shaft in a below floor mechanism pit covered by a pit cover 15. Such an arrangement is well known in the art and therefore need not be described in greater detail.

At their upper ends, the racks 14 are fixedly secured to respective bolsters 17 desirably in the form of heavy gauge steel plates adequate to support the weight of a vehicle. Cap screws 18 (FIG. 2) may be means for securing the upper ends of the racks 14 detachably to the undersides of the respective bolsters 17. Separable attachment of the bolsters 17 in supported relation on top of the respective plungers or pistons 11 may be effected by means of a plurality, such as six, cap screws 19 in each instance.

Figure 6:
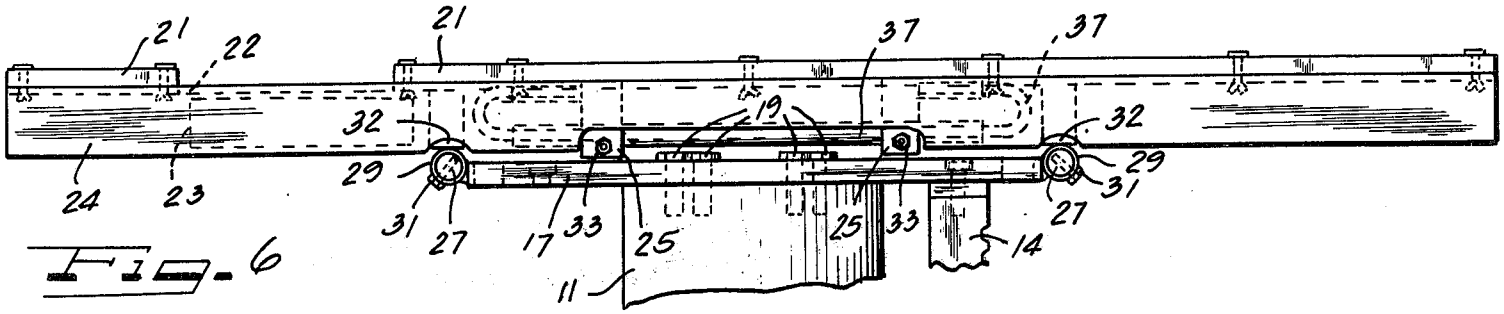
FIG. 6 is an elevational view looking toward the bottom side of FIG. 5.

Carried by each of the bolsters 17 is a respective vehicle engaging and supporting cross member or pad 20 each of which may comprise a suitable length of inverted channel bar adequate to engage supportingly under an automotive vehicle undercarriage or chassis for lifting the vehicle, and more particularly to engage the longitudinally extending side rails or bars of the vehicle chassis frame. On their top faces each of the pads 20 has a resilient facing cushion which is desirably formed from a grease and oil resistant elastomer. The pads 20 are dimensioned relative to the supporting bolsters 17 to project substantially beyond opposite sides of the bolster in a manner to afford maximum accessibility. In those portions of the pads 20 which extend forwardly relative to the supported vehicle, there is preferably provided an opening 22 which permits removal of forward cross members of certain makes of automobiles so that the transmissions of those automobiles can be serviced. In the areas of the openings 22, reinforcing plates 23 (FIGS. 2, 5 and 6) of substantially the length of the openings are secured as by welding two depending longitudinal side flanges 24 of the bars comprising the pads.

Each of the pads 20 is desirably in the form of an elongate inverted channel beam bar with means desirably in the form of sturdy bearing blocks 25 facing downwardly for engagement with the supporting bolster to transfer vehicle load from the pad to the bolster. In a desirable construction, each of the pads 20 carries a pair of the load transfer blocks 25 spaced longitudinally along the preferably central portion of the associated pad bar with sufficient space between the blocks to clear the attachment screws 19 when the pad 20 is adjusted laterally along the supporting bolster. The load transfer blocks 25 are desirably secured as by means of welding to the undersides of the associated bars of the pads 20 between the side flanges 24 and with the lower bearing faces of the blocks 25 projecting just enough below the lower edges of the flanges 24 to engage the upwardly facing surface of the bolster 17 under vehicle load. A bracing bar 26 may be welded to and between the blocks 25.

Means are provided for supporting the unloaded pad 20 in each instance for adjustment into selected position over the bolster 17 in such a manner as to maintain the pad at an elevation wherein the load transfer blocks 25 are supported free of the bolsters 17 to permit free adjustments of the pad, that is free from frictional interference or resistance from contact of the bearing surfaces of the blocks 25 and the bolster 17. For this purpose, the bolster 17 carries guide rods 27 in parallel coextensively extending relation along opposite sides and transversely relative to the length of the pad 20. The pad 20 carries bearing means in the form of respective loops 28 in guiding engagement with the rods. Each of the rods 27 desirably extends substantially throughout the length of the side of the bolster 17 to which it is attached at each end by means of respective tubular elements 29 providing sockets into which the ends of the rod are adapted to be assembled slidably after being assembled slidably through the bearing tubes 28. Each of the socket elements 29 is adapted to be secured to the adjacent edge of the bolster 17 as by means of welding. In order to provide clearance for free movement of the bearing tube 28 along the rod 27, the edge of the bolster between the socket elements 29 is provided with an inset clearance recess 30. To secure the rod 27 against displacement, a transverse anchoring screw 31 is adapted to be threaded through the wall of one of the socket elements 29 into the associated end portion of the rod.

Each of the bearing tube sleeves 28 is desirably affixed to the associated pad 20 by welding it onto the lower face of a spacer block 32 secured as by means of welding to the underface of the bar of the pad 20 between the side flanges 24 in vertical alignment over the rods 27. Further, the vertical dimension of the sleeve carrying blocks 32, and the vertical location of the rods 27 along the sides of the bolster 17 are such that the unloaded pad 20 is supported at an elevation relative to the bolster 17 such that the load transfer blocks 25 are supported free of the bolster to permit free adjustments of the pad 20 over the bolster 17 by sliding the pad along the rods 27. Resilience of the material of the rods 27 is selected in relation to the length and diameter of the rods to permit limited resilient yielding downward deflection of the rods 27 as indicated by the directional arrow in FIG. 3 so that the blocks 25 will move down into bearing engagement with the bolster 17 and transfer the vehicle load to the bolster, relieving the rods 27 from any damaging load stress.

In use, the surface of the rods 27 should be greased to facilitate adjustment movements of the sleeves 28 therealong. Also, it is desirable to grease the opposing bearing surfaces of the load transfer blocks 25 and the bolster 17. This is facilitated by providing each of the blocks 25 with a grease fitting 33 communicating with a grease passage 34 leading to a grease distribution channel groove 35 in the lower face of the block 25.

In order to facilitate movable adjustment of the pad 20 in each instance, the outer side is desirably equipped with an elongate handle 37 which may comprise a bar having turned ends pivotally engaged in respective tubular eyes 38 secured as by means of welding to the central portion of the side of the pad as best seen in FIGS. 1, 3, 4 and 5.

In use, the hydraulic lift structure is initially depressed so that the bolsters 17 lie substantially on the floor 13, the silhouette of the bolster and pad assembly being so low that a vehicle such as an automobile can be easily driven into position over the lift. After the vehicle is in position, the pads 20 are adjusted to line up with the longitudinal rails of the undercarriage frame of the vehicle. Such adjustment can be very easily and accurately effected because the pads 20 are supported in limited bearing relation by the bearing sleeves 28. Following adjustment of the pads 20 into position, the pistons 11 are hydraulically operated to raise the pads 20 into engagement with the undercarriage of the vehicle and as the load of the lifted vehicle is imposed on the pads, the load is transferred through the blocks 25 to the bolster 17 and thereby to the pistons 11. When the vehicle is lowered to again rest on the surface 13, and the vehicle load thereby released from the pads 20, the resilient guide rods resume their supporting relation of the pads 20 through the sleeves 28 and raise the load transfer blocks 25 into the slight clearance relation to the surface of the bolster whereupon the pads 20 can be easily moved out of range of the wheels of the vehicle which then can be driven away.

It will be understood that variations and modifications may be effected without departing from the spirit and scope of the novel concepts of this invention.

I claim as my invention:

1. In an adjustable pad hydraulic lift structure wherein a vehicle engaging and supporting pad is vertically movable by means of a hydraulic piston to engage under an automotive vehicle undercarriage for lifting the vehicle:

a bolster having means for securing the bolster on the upper end of the piston;

said pad carried by the bolster;

load transfer means facing downwardly on the pad for engagement with the bolster to transfer vehicle load from the pad to the bolster;

supporting and guide means on the bolster and on the pad cooperating to support the unloaded pad for adjustment into selected position over the bolster, and while supporting the unload pad maintaining the pad at an elevation wherein said load transfer means for supported free of the bolster to permit free adjustment of the pad;

said pad supporting and guide means being yieldable when the pad is under vehicle load to permit said load transfer means to engage the bolster for load transfer from the pad to the bolster;

said pad comprising an elongate beam;

said load transfer means comprising load supporting block structures secured to the underside of said pad beam;

and means on the block structure for lubricating the interface between the block structure and the bolster.

2. A hydraulic lift structure according to claim 1, wherein said pad comprises a beam having opposite end portions which project substantially beyond said bolster, one of said end portions having a substantial clearance opening through the top of the pad to permit ready access to mechanism of the vehicle undercarriage that would otherwise be inaccessible when the vehicle is lifted by the lift structure.

3. In an adjustable pad hydraulic lift structure wherein a vehicle supporting pad is vertically movable by means of a hydraulic piston to engage under an automotive vehicle undercarriage for lifting the vehicle:

a bolster having means for securing the bolster to the top of the piston;

load transfer means on said pad for engaging the bolster to transfer vehicle load from the bolster;

guide rods carried in parallel coextensively extending relation along opposite sides of the bolster;

and bearing means on said pad in guiding engagement with said rods to facilitate adjusting the position of the pad on the bolster;

said guide rods being supported at their opposite ends and being resiliently flexibly deflectable between said ends and being adapted to cooperate with said bearing means to hold said pad and load transfer means at a slightly raised elevation relative to the bolster so that the load transfer means is raised above the bolster in the unloaded condition of the pad but said rods are resiliently flexibly deflectable downwardly in the loaded condition of the pad whereby to then permit the load transfer means to engage the bolster for load transfer.

4. In an adjustable pad hydraulic lift structure wherein a vehicle engage and supporting pad is vertically movable by means of a hydraulic piston to engage under an automotive vehicle undercarriage for lifting the vehicle:

a bolster having means for securing the bolster on the upper end of the piston;

said pad carried by the bolster;

load transfer means facing downwardly on the pad for engagement with the bolster to transfer vehicle load from the pad to the bolster;

supporting and guide means on the bolster and on the pad cooperating to support the unloaded pad for adjustment into selected position over the bolster, and while supporting the unloaded pad maintaining the pad at an elevation wherein said load transfer means are supported free of the bolster to permit free adjustments of the pad;

said supporting and guide means being yieldable when the pad is under vehicle load to permit said load transfer means to engage the bolster for load transfer from the pad to the bolster;

said supporting and guide means comprising guide rods carried in parallel coextensively extending relation along opposite sides of the bolster and supported at their opposite ends so as to be resiliently deflectable intermediate said ends;

and bearing means on said pad in guiding engagement with said rods.

5. A hydraulic lift structure according to claim 4, wherein said bearing means comprise sleeves fixedly mounted on the underside of said pad and slidably engaging said rods.

6. A hydraulic lift structure according to claim 4, wherein said bolster comprises a horizontal metal plate, tubular sockets permanently attached to opposite sides of the plate in longitudinally spaced coaxially aligned relation at each side of the plate, said rods being slidably assembled in said sockets, and means securing the rods against displacement from the sockets.

7. A hydraulic lift structure according to claim 6, wherein said bearing means comprise sleeves, means fixedly securing the sleeves to the underside of said pad, and said rods extending through said sleeves, whereby the pad is guided by cooperation of the sleeves and rods in a rectilinear adjustment path over the bolster and the rods are resiliently yieldably deflectable downwardly when the path is under vehicle load so that said load transfer means can make load transferring contact with the bolster.

8. In an adjustable pad hydraulic lift structure wherein a vehicle supporting pad is vertically movable by means of a hydraulic piston to engage under an automotive vehicle undercarriage for lifting the vehicle:

a bolster having means for securing the bolster to the top of the piston;

load transfer means on said pad for engaging the bolster to transfer vehicle load from the bolster;

guide rods carried in parallel coextensively extending relation along opposite sides of the bolster;

bearing means on said pad in guiding engagement with said rods to facilitate adjusting the position of the pad on the bolster;

said bolster comprising a horizontal metal plate and said means for securing the bolster comprising bolts;

said pad comprising an elongate metal beam;

said load transfer means comprising bearing blocks welded to the underside of the beam and in spaced relation to clear said bolts;

means for lubricating bearing surfaces of said blocks;

supporting tubular sockets welded to opposite sides of said bolster in substantially spaced relation and in coaxial alignment;

said guide rods being slidably engaged at their opposite ends in said sockets;

means securing the guide rods against displacement from said sockets;

said bearing means comprising bearing sleeves slidably engaged about the guide rods between said sockets;

spacer blocks welded to the undersides of the pad beam and said sleeves welded to said spacer blocks;

the span of said rods between said sockets permitting resilient deflection of the rods under load;

and said sockets and rods and sleeves being coordinated to support the pad beam and said load transfer blocks at an elevation to hold the blocks in spaced relation to the bolster in the unloaded condition of the pad and the rods being resiliently deflectable when the pad is placed under vehicle load to yield resiliently and deflect downwardly so that the load transfer blocks then engage in load transfer relation with the bolster.

9. In an adjustable pad hydraulic lift structure wherein a vehicle supporting pad is vertically movable by means of a hydraulic piston to engage under an automotive vehicle undercarriage for lifting the vehicle:

a bolster plate having means for securing the bolster plate to the top of the piston;

deflectable guide rods carried in parallel coextensively extending relation along opposite sides of the bolster plate;

said pad comprising a bar extending over and across said guide rods and projecting beyond opposite sides of said bolster plate;

bearing means on said pad in guiding engagement with said rods to facilitate adjusting the position of the pad over the bolster plate longitudinally along said rods;

and load transfer means on said pad between said opposite sides of the bolster plate for engaging the top of the bolster plate to transfer vehicle load from the pad to the bolster plate;

said bearing means and said rods cooperating for holding said pad and said load transfer means free from said bolster plate in the unloaded condition of the pad to facilitate moving the pad along said rods, and the rods being deflectable and thereby permitting depressing of said pad for engagement of said load transfer means with the top of the bolster when the pad is subjected to vehicle load.

10. A hydraulic lift structure according to claim 9, wherein said pad comprises a channel beam having downwardly projecting longitudinally extending side flanges, and said load transfer means comprise bearing blocks mounted on the underside of said beam between said flanges.

11. A hydraulic lift structure according to claim 10, including means for greasing bearing surfaces of the blocks.

12. A hydraulic lift structure according to claim 9, wherein said bolster has spaced and coaxially aligned sockets on its opposite sides, and said guide rods are supported at their ends in said sockets leaving the intermediate portions of the guide rods free for engagement and longitudinal adjustment therealong of said bearing means.

13. A hydraulic lift structure according to claim 12, wherein said bearing means comprise bearing sleeves engaged slidably about said intermediate portions of the rods.

14. A hydraulic lift structure according to claim 9, wherein said guide rods are supported at their opposite ends and are resiliently flexibly deflectable between said ends and are adapted to cooperate with said bearing means to hold said pad and load transfer means at a slightly raised elevation relative to the bolster so that the load transfer means is raised above the bolster in the unloaded condition of the pad but said rods are resiliently flexibly deflectable downwardly in the loaded condition of the pad whereby to then permit the load transfer means to engage the bolster for load transfer.

15. A hydraulic lift structure according to claim 9, wherein said bolster comprises a horizontal metal plate, said means for securing the bolster comprise bolts, said pad comprises an elongate metal beam, said load transfer means comprise bearing blocks welded to the underside of the beam and in spaced relation to clear said bolts, means for lubricating bearing surfaces of said blocks, supporting tubular sockets welded to opposite sides of said bolster in substantially spaced relation and in coaxial alignment, said guide rods being slidably engaged at their opposite ends in said sockets, means securing the guide rods against displacement from said sockets, said bearing means comprising bearing sleeves slidably engaged about the guide rods between said sockets, spacer blocks welded to the undersides of the pad beam and said sleeves welded to said spacer blocks, the span of said rods between said sockets permitting resilient deflection of the rods under load, and said sockets and rods and sleeves being coordinated to support the pad beam and said load transfer blocks at an elevation to hold the blocks in spaced relation to the bolster in the unloaded condition of the pad and the rods being resiliently deflectable when the pad is placed under vehicle load to yield resiliently and deflect downwardly so that the load transfer blocks then engage in load transfer relation with the bolster.

16. In an adjustable pad hydraulic lift structure wherein a vehicle supporting pad is vertically movable by means of a hydraulic piston to engage under an automotive vehicle undercarriage for lifting the vehicle:

a bolster having means for securing the bolster to the top of the piston;

load transfer means on said pad for engaging the bolster to transfer vehicle load from the bolster;

guide rods carried in parallel coextensively extending relation along opposite sides of the bolster;

bearing means on said pad in guiding engagement with said rods to facilitate adjusting the position of the pad on the bolster;

said pad comprising a channel beam having downwardly projecting longitudinally extending side flanges;

said load transfer means comprising bearing blocks mounted on the underside of said beam between said flanges;

and means for greasing bearing surfaces of the blocks.

* * * * *